US009805674B2

(12) United States Patent
Syu et al.

(10) Patent No.: US 9,805,674 B2
(45) Date of Patent: Oct. 31, 2017

(54) ADJUSTING METHOD OF DISPLAY PARAMETER AND LIQUID CRYSTAL DISPLAY SYSTEM

(71) Applicant: Shenzhen China Star Optoelectronics Technology Co., Ltd., Shenzhen, Guangdong (CN)

(72) Inventors: Shen-sian Syu, Guangdong (CN); Yugang Bao, Guangdong (CN); Jian He, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 293 days.

(21) Appl. No.: 14/408,839

(22) PCT Filed: Nov. 25, 2014

(86) PCT No.: PCT/CN2014/092127
§ 371 (c)(1),
(2) Date: Dec. 17, 2014

(87) PCT Pub. No.: WO2016/078103
PCT Pub. Date: May 26, 2016

(65) Prior Publication Data

US 2016/0351139 A1 Dec. 1, 2016

(30) Foreign Application Priority Data

Nov. 18, 2014 (CN) ..... 2014 1 0660208

(51) Int. Cl.
*G09G 3/20* (2006.01)
*G09G 3/36* (2006.01)

(52) U.S. Cl.
CPC ..... *G09G 3/3648* (2013.01); *G09G 3/2011* (2013.01); *G09G 3/36* (2013.01);
(Continued)

(58) Field of Classification Search
CPC ..... G09G 2320/06; G09G 3/3648; G09G 3/2011; G09G 2310/08; G09G 2320/0247;
(Continued)

(56) References Cited

U.S. PATENT DOCUMENTS 5,774,099 A * 6/1998 Iwasaki ..... G09G 3/3655 345/87
6,166,714 A * 12/2000 Kishimoto ..... G09G 3/3655 345/209
(Continued)

FOREIGN PATENT DOCUMENTS

CN 101211035 A 7/2008
CN 101408705 A 4/2009
(Continued)

OTHER PUBLICATIONS

SIPO First Office Action for 201410660208.6.*
(Continued)

*Primary Examiner* — Julie Anne Watko
(74) *Attorney, Agent, or Firm* — Andrew C. Cheng

(57) ABSTRACT

An adjusting method of display parameter and a liquid crystal display (LCD) system are provided. The adjusting method includes: obtaining a first luminance value and a second luminance value when a LCD panel displaying a minimum grayscale image and a maximum grayscale image respectively; based on the first luminance value, the second luminance value and a standard Gamma curve of the LCD panel, obtaining each target luminance value conforming to the standard Gamma curve and corresponding to each grayscale; based on the target luminance value of each grayscale and a relationship between grayscale voltage and luminance obtained in advance, obtaining a target grayscale voltage of each grayscale; and adjusting a grayscale voltage of each grayscale to be the target grayscale voltage of the grayscale
(Continued)

to thereby achieve Gamma adjustment. By the above method, automatic adjustment of display parameter for the LCD panel can be achieved.

10 Claims, 4 Drawing Sheets

(52) U.S. Cl.
CPC ... *G09G 2310/063* (2013.01); *G09G 2310/08* (2013.01); *G09G 2320/029* (2013.01); *G09G 2320/0247* (2013.01); *G09G 2320/0276* (2013.01); *G09G 2320/0626* (2013.01); *G09G 2320/0673* (2013.01); *G09G 2320/0693* (2013.01)

(58) Field of Classification Search
CPC ..... G09G 2320/0276; G09G 2320/029; G09G 2320/0626; G09G 2320/0673; G09G 3/38; G09G 3/3629; G09G 3/3607; G09G 3/344; G09G 3/3453; G09G 3/2007; G09G 3/2018; G09G 3/2022; G09G 2310/04; G09G 2310/061; G09G 2310/063; G09G 2320/0257; G09G 2320/0252; G09G 2320/0233; G09G 2320/0209; G09G 2320/02; G09G 2320/00; G09G 2320/04; G09G 2320/062; G09G 2320/0693; G09G 2320/0295
USPC ..... 345/207
See application file for complete search history.

(56) References Cited

U.S. PATENT DOCUMENTS 6,304,300 B1 * 10/2001 Warren ..... G09G 5/06 348/254
6,831,620 B1 * 12/2004 Nishikubo ..... G09G 3/3688 345/690
7,317,460 B2 * 1/2008 Kim ..... G09G 3/3611 345/690
7,372,507 B2 * 5/2008 Ikeda ..... H04N 5/202 348/674
8,253,671 B2 * 8/2012 Kim ..... G09G 3/3611 345/204
2003/0169248 A1 * 9/2003 Kim ..... G09G 3/3611 345/204
2005/0062704 A1 * 3/2005 Whittington ..... G09G 3/006 345/89
2005/0212726 A1 * 9/2005 Namba ..... G09G 3/22 345/63
2006/0132415 A1 * 6/2006 Yu ..... G09G 3/3655 345/98
2007/0120806 A1 * 5/2007 Schmidt ..... G09G 3/3648 345/102
2007/0285442 A1 * 12/2007 Higgins ..... G09G 3/20 345/690
2008/0030526 A1 * 2/2008 Brown Elliott ..... G09G 3/20 345/694
2008/0218463 A1 * 9/2008 Lee ..... G09G 3/3696 345/89
2008/0278470 A1 * 11/2008 Im ..... G09G 3/3688 345/211
2011/0050737 A1 * 3/2011 Yu ..... G09G 3/2003 345/690
2012/0120124 A1 * 5/2012 Zhang ..... G09G 3/3648 345/690
2014/0146096 A1 * 5/2014 You ..... G09G 3/3607 345/690
2015/0116373 A1 * 4/2015 Kim ..... G09G 3/3614 345/690
2015/0243198 A1 * 8/2015 Zhang ..... G09G 3/20 345/690
2016/0071475 A1 * 3/2016 Su ..... G09G 3/3696 345/690
2016/0148559 A1 * 5/2016 Kim ..... G09G 3/3208 345/690
2016/0189347 A1 * 6/2016 Hu ..... G06T 5/00 345/589
2016/0225344 A1 * 8/2016 Joo ..... G09G 5/10
2016/0247451 A1 * 8/2016 Kim ..... G09G 3/3258
2016/0267842 A1 * 9/2016 Zhang ..... G09G 3/2011
2016/0267855 A1 * 9/2016 He ..... G09G 3/36
2016/0293116 A1 * 10/2016 Wang ..... G09G 3/3655
2016/0307493 A1 * 10/2016 Song ..... G09G 3/32
2016/0343317 A1 * 11/2016 Syu ..... G02F 1/133

FOREIGN PATENT DOCUMENTS

CN 101937634 A 1/2011
CN 102467862 A * 5/2012 ..... G09G 3/3648
CN 103325357 A * 9/2013 ..... G09G 3/3648
CN 103680438 A 3/2014
CN 103761956 A * 4/2014
CN 103761956 A 4/2014
CN 103926714 A 7/2014
CN 102467862 B * 8/2014 ..... G09G 3/3648
CN 105139345 A * 12/2015
CN 103761956 B * 3/2016
JP 2008197635 A * 8/2008
KR 1020050079136 A 8/2005
KR 20080043604 A * 5/2008

OTHER PUBLICATIONS

PCT Written Opinion, PCT/CN2014/092127, dated Nov. 25, 2014.*
English Oral Translation of PCT Written Opinion, PCT/CN2014/092127, dated Nov. 25, 2014.*

* cited by examiner

ADJUSTING METHOD OF DISPLAY PARAMETER AND LIQUID CRYSTAL DISPLAY SYSTEM

TECHNICAL FIELD

The invention relates to the field of liquid crystal display technology, and particularly to an adjusting method of display parameter and a liquid crystal display system.

DESCRIPTION OF RELATED ART

In order to make the display of a liquid crystal display panel to meet the user requirement, display parameters such as gamma curve and flicker value generally are needed to be configured. Accordingly, in the production of liquid crystal display panels, manufacturers would configure a set of standard gamma curve and flicker value to meet the user's specifications.

However, in the liquid crystal display panel production process, due to differences in manufacturing processes and materials, the gamma curve and the flicker value of each piece of liquid crystal display panel would have deviations. If the gamma curve and the flicker value of the liquid crystal display panel are manually adjusted piece by piece on the production line, which would cause significant increase in manpower and time.

SUMMARY

Accordingly, the present application provides an adjusting method of display parameter and a liquid crystal display system, which can realize automatic adjustment of display parameter for a liquid crystal display panel.

A first aspect of the present application provides an adjusting method of display parameter, which includes: obtaining a first luminance value when a liquid crystal display panel displaying an image of a minimum grayscale and a second luminance value when the liquid crystal display panel displaying an image of a maximum grayscale; based on the first luminance value, the second luminance value and a standard Gamma curve of the liquid crystal display panel, obtaining a target luminance value of each grayscale conforming to the standard Gamma curve; based on the target luminance value of each grayscale and a relationship between grayscale voltage and luminance value of the liquid crystal display panel obtained in advance, obtaining a target grayscale voltage of each grayscale of the liquid crystal display panel; and adjusting a grayscale voltage of each grayscale of the liquid crystal display panel to be the target grayscale voltage of the grayscale, to thereby achieve Gamma adjustment of the liquid crystal display panel.

Combined with the first aspect, in a first possible embodiment of the first aspect, the step of based on the first luminance value, the second luminance value and a standard Gamma curve of the liquid crystal display panel, obtaining a target luminance value of each grayscale conforming to the standard Gamma curve concretely includes: based on the first luminance value, the second luminance value and an expression (1), obtaining the target luminance value of each grayscale conforming to the standard Gamma curve, wherein the expression (1) is:

$$\frac{L_x - L_{min}}{L_{max} - L_{min}} = \left(\frac{x}{G_{max}}\right)^{\gamma} \quad (1)$$

where $L_x$ is a calculated target luminance value of a grayscale x, $L_{min}$ is the first luminance value, $L_{max}$ is the second luminance value, x is any grayscale between the minimum grayscale and the maximum grayscale, $G_{max}$ is the maximum grayscale, $\gamma$ is a standard Gamma value of the liquid crystal display panel.

Combined with the first aspect, in a second possible embodiment of the first aspect, before the step of obtaining a first luminance value when a liquid crystal display panel displaying an image of a minimum grayscale and a second luminance value when the liquid crystal display panel displaying an image of a maximum grayscale, the adjusting method of display parameter further includes: making the liquid crystal display panel to display an image of a preset grayscale, wherein the preset grayscale is no less than two thirds of the maximum grayscale; making a common voltage Vcom of the liquid crystal display panel to change in a preset first voltage range and obtaining a minimum flicker value of the liquid crystal display panel in the change process of the Vcom of the liquid crystal display panel; and taking a Vcom of the liquid crystal display panel corresponding to the minimum flicker value as an optimal Vcom, and adjusting the Vcom of the liquid crystal display panel to be the optimal Vcom.

Combined with the first aspect, in a third possible embodiment of the first aspect, the adjusting method further includes: making an adjustment voltage $\Delta V_x$ of a grayscale x of the liquid crystal display panel to change in a preset second voltage range and obtaining flicker values $F(\Delta V_x)$ of the liquid crystal display panel in the change process of the adjustment voltage $\Delta V_x$ of the grayscale x, wherein the x is any grayscale between the minimum grayscale and the maximum grayscale, the adjustment voltage $\Delta V_x$ of the grayscale x is a voltage amount of a positive voltage and a negative voltage corresponding to the grayscale x both being changed; obtaining flicker values $F(\Delta V'_x)$ less than a preset flicker value from the flicker values $F(\Delta V_x)$ of the liquid crystal display panel corresponding to the grayscale x, and obtaining an optimal adjustment voltage of the grayscale x based on adjustment voltages $\Delta V'_x$ corresponding to the flicker values $F(\Delta V_x)$ of the grayscale x; and adjusting the positive voltage and the negative voltage corresponding to the grayscale x as per the optimal adjustment voltage of the grayscale x, to thereby achieve flicker value adjustment of the liquid crystal display panel.

Combined with the third possible embodiment of the first aspect, in a fourth possible embodiment of the first aspect, the step of obtaining flicker values $F(\Delta V'_x)$ less than a preset flicker value from the flicker values $F(\Delta V_x)$ of the liquid crystal display panel corresponding to the grayscale x, and obtaining an optimal adjustment voltage of the grayscale x based on adjustment voltages $\Delta V'_x$ corresponding to the flicker values $F(\Delta V'_x)$ of the grayscale x concretely includes: obtaining a minimum flicker value $F(\Delta V_x^{min})$ from the flicker values $F(\Delta V_x)$ of the liquid crystal display panel corresponding to the grayscale x, and taking an adjustment voltage $\Delta V_x^{min}$ corresponding to the minimum flicker value $F(\Delta V_x^{min})$ as the optimal adjustment voltage of the grayscale x.

A second aspect of the present application provides an adjusting method of display parameter, which includes: making an adjustment voltage $\Delta V_x$ of a grayscale x of a liquid crystal display panel to change in a preset second voltage range and obtaining flicker values $F(\Delta V_x)$ of the liquid crystal display panel in the change process of the adjustment voltage $\Delta V_x$ of the grayscale x, wherein the x is any grayscale between a minimum grayscale and a maximum grayscale, the adjustment voltage $\Delta V_x$ of the grayscale x is a voltage amount of a positive voltage and a negative voltage corresponding to the grayscale x both being changed; obtaining flicker values $F(\Delta V'_x)$ less than a preset flicker value from the flicker values $F(\Delta V_x)$ of the liquid crystal display panel corresponding to the grayscale x, and obtaining an optimal adjustment voltage of the grayscale x based on adjustment voltages $\Delta V'_x$ corresponding to flicker values $F(\Delta V'_x)$ of the grayscale x; and adjusting a grayscale voltage of the grayscale x as per the optimal adjustment voltage of the grayscale x, to thereby achieve flicker value adjustment of the liquid crystal display panel.

Combined with the second aspect, in a first possible embodiment of the second aspect, before the step of making an adjustment voltage $\Delta V_x$ of a grayscale x of a liquid crystal display panel to change in a preset second voltage range and obtaining flicker values $F(\Delta V_x)$ of the liquid crystal display panel in the change process of the adjustment voltage $\Delta V_x$ of the grayscale x, the adjusting method further includes: making the liquid crystal display panel to display an image of a preset grayscale, wherein the preset grayscale is no less than two thirds of the maximum grayscale; making a common voltage Vcom of the liquid crystal display panel to change in a preset first voltage range and obtaining a minimum flicker value of the liquid crystal display panel in the change process of the Vcom of the liquid crystal display panel; and taking a Vcom of the liquid crystal display panel corresponding to the minimum flicker value as an optimal Vcom, and adjusting the Vcom of the liquid crystal display panel to be the optimal Vcom.

A third aspect of the present application provides a liquid crystal display system, which includes: a liquid crystal panel, an optical sensor and an adjusting apparatus of display parameter. The optical sensor is configured for acquiring luminance information of the liquid crystal display panel. The luminance information of the liquid crystal display panel comprises a luminance value and a flicker value of the liquid crystal display panel. The adjusting apparatus of display parameter is configured for adjusting a display parameter(s) of the liquid crystal display panel based on the luminance information acquired by the optical sensor. The adjusting apparatus of display parameter includes an acquiring module, a first getting module, a second getting module and a first adjusting module; or includes a first obtaining module, a second obtaining module and a second adjusting module. Specifically, the acquiring module is configured to acquire a first luminance value when the liquid crystal display panel displaying an image of a minimum grayscale and a second luminance value when the liquid crystal display panel displaying an image of a maximum grayscale, and further send the first luminance value and the second luminance value to the first getting module. The first getting module is configured to, based on the first luminance value, the second luminance value and a standard Gamma curve of the liquid crystal display panel, obtain a target luminance value of each grayscale conforming to the standard Gamma curve, and further send the target luminance value of each grayscale to the second getting module. The second getting module is configured to, based on the target luminance value of each grayscale and a relationship between grayscale voltage and luminance value of the liquid crystal display panel obtained in advance, obtain an target grayscale voltage of each grayscale and further send the target grayscale voltage of each grayscale to the first adjusting module. The first adjusting module is configured to adjust a grayscale voltage of each grayscale of the liquid crystal display panel to be the target grayscale voltage of the grayscale, to thereby achieve Gamma adjustment of the liquid crystal display panel. The first obtaining module is configured to make an adjustment voltage $\Delta V_x$ of a grayscale x of the liquid crystal display panel to change in a preset second voltage range, obtain flicker values $F(\Delta V_x)$ of the liquid crystal display panel in the change process of the adjustment voltage $\Delta V_x$ of the grayscale x and further send the flicker values $F(\Delta V_x)$ of the liquid crystal display panel corresponding to the grayscale x to the second getting module, the x is any grayscale between the minimum grayscale and the maximum grayscale, the adjustment voltage $\Delta V_x$ of the grayscale x is a voltage amount of a positive voltage and a negative voltage corresponding to the grayscale x both being changed. The second getting module is configured to obtain flicker values $F(\Delta V'_x)$ less than a preset flicker value from the flicker values $F(\Delta V_x)$ of the liquid crystal display panel corresponding to the grayscale x and get an optimal adjustment voltage of the grayscale x based on adjustment voltages $\Delta V'_x$ corresponding to the flicker values $F(\Delta V'_x)$ of the grayscale x, and further send the optimal adjustment voltage of the grayscale x to the second adjusting module. The second adjusting module is configured to adjust a grayscale voltage of the grayscale x as per the optimal adjustment voltage of the grayscale x, to thereby achieve flicker value adjustment of the liquid crystal display panel.

Combined with the third aspect, in a first possible embodiment of the third aspect, the first getting module concretely is configured to, based on the first luminance value, the second luminance value and an expression (1), obtain the target luminance value of each grayscale conforming to the standard Gamma curve, the expression (1) is as follows:

$$\frac{L_x - L_{min}}{L_{max} - L_{min}} = \left(\frac{x}{G_{max}}\right)^{\gamma} \tag{1}$$

where $L_x$ is a calculated target luminance value of the grayscale x, $L_{min}$ is the first luminance value, $L_{max}$ is the second luminance value, x is any grayscale between the minimum grayscale and the maximum grayscale, $G_{max}$ is the maximum grayscale, and $\gamma$ is a standard Gamma value of the liquid crystal display panel.

Combined with the third aspect, in a second possible embodiment of the third aspect, the adjusting apparatus further includes a display module, a third obtaining module and a third adjusting module. The display module is configured to make the liquid crystal display panel to display an image of a preset grayscale, the preset grayscale being no less than two thirds of the maximum grayscale. The third obtaining module is configured to make a common voltage Vcom of the liquid crystal display panel to change in a preset first voltage range and obtain a minimum flicker value of the liquid crystal display panel in the change process of the Vcom of the liquid crystal display panel. The third adjusting module is configured to take a Vcom of the liquid crystal display panel corresponding to the minimum flicker value as an optimal Vcom and further adjust the Vcom of the liquid crystal display panel to be the optimal Vcom.

Combined with the third aspect, in a third possible embodiment of the third aspect, the second obtaining module concretely is configured to obtain a minimum flicker value $F(\Delta V_x^{min})$ from the flicker values $F(\Delta V_x)$ of the liquid crystal display panel corresponding to the grayscale x and further take an adjustment voltage $\Delta V_x^{min}$ corresponding to the minimum flicker value $F(\Delta V_x^{min})$ as the optimal adjustment voltage of the grayscale x.

In the above solutions, by measuring the luminance information of the liquid crystal display panel and adjusting the grayscale voltage of each grayscale of the liquid crystal display panel based on the measured luminance information of the liquid crystal display panel, automatic adjustment of display parameters such as Gamma and flicker value of the liquid crystal display panel is achieved consequently.

BRIEF DESCRIPTION OF THE DRAWINGS

In order to more clearly illustrate the technical solutions of various embodiments of the invention, drawings will be used in the description of embodiments will be given a brief description below. Apparently, the drawings in the following description only are some embodiments of the invention, the ordinary skill in the art can obtain other drawings according to these illustrated drawings without creative effort. In the drawings.

DETAILED DESCRIPTION OF EMBODIMENTS

In the following description, for the purpose of illustration but not for limitation, concrete details such as specific system architectures, interfaces and technologies and the like would be provided, so as to clearly understand the present application. However, the skilled person will appreciate that other embodiment without these concrete details also can be implemented in the present invention. In other instances, detailed description for well-known devices, circuits and methods is omitted, in order to avoid unnecessary detail impeding the description of the present application.

Figure 1:
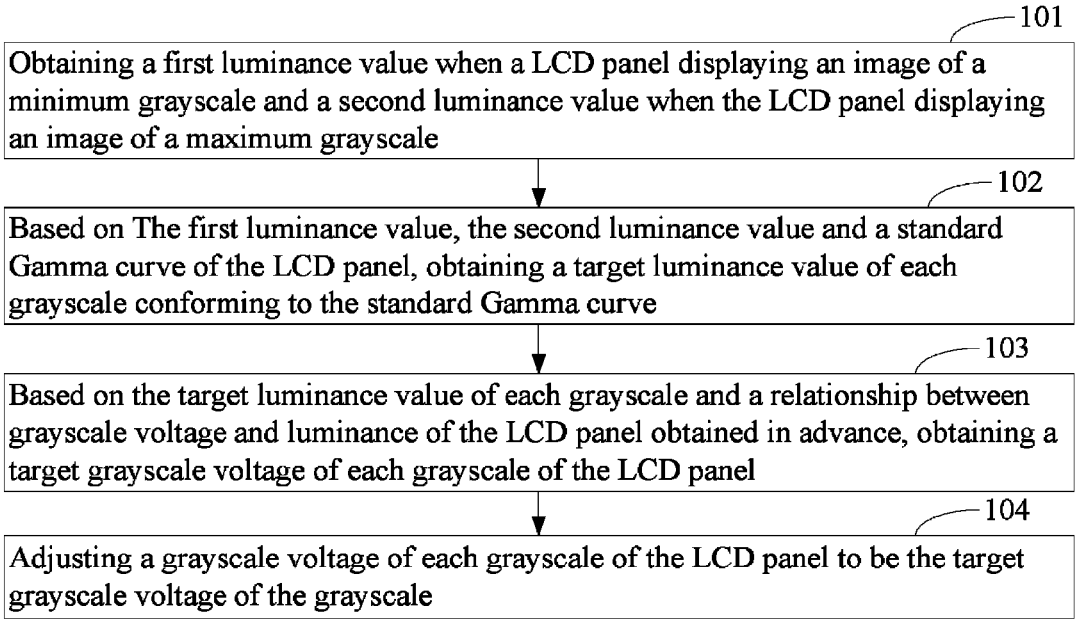
FIG. 1 is a flowchart of an embodiment of an adjusting method of display parameter of the present application.

Referring FIG. 1, FIG. 1 is a flowchart of an embodiment of an adjusting method of display parameter of the present application. In this embodiment, a display parameter required to be adjusted is gamma curve of a liquid crystal display panel. The adjusting method includes the following steps.

101: obtaining a first luminance value when a liquid crystal display panel displaying an image of a minimum grayscale and a second luminance value when the liquid crystal display panel displaying an image of a maximum grayscale.

For example, a pattern generator is enabled to generate a minimum grayscale signal and input to the liquid crystal display panel for making the liquid crystal display panel to display the image of the minimum grayscale, and an optical sensor (e.g., photo diode) is used to measure a luminance of the liquid crystal display panel at this time as the first luminance value. The pattern generator is enabled to generate a maximum grayscale signal and input to the liquid crystal display panel for making the liquid crystal display panel to display the image of the maximum grayscale, and the optical sensor is used to measure a luminance of the liquid crystal display panel at this time as the second luminance value.

102: Based on the first luminance value, the second luminance value and a standard Gamma curve of the liquid crystal display panel, obtaining a target luminance value of each grayscale conforming to the standard Gamma curve.

For example, based on the first luminance value, the second luminance value and an expression (1), the target luminance value of each grayscale conforming to the standard Gamma curve is obtained. The expression (1) is as follows:

$$\frac{L_x - L_{min}}{L_{max} - L_{min}} = \left(\frac{x}{G_{max}}\right)^{\gamma} \tag{1}$$

where $L_x$ is a calculated target luminance value of a grayscale x, $L_{min}$ is the first luminance value, $L_{max}$ is the second luminance value, x is any grayscale between the minimum grayscale and the maximum grayscale, $G_{max}$ is the maximum grayscale, $\gamma$ is a standard Gamma value of the liquid crystal display panel.

103: based on the target luminance value of each grayscale and a relationship between grayscale voltage and luminance of the liquid crystal display panel obtained in advance, obtaining a target grayscale voltage of each grayscale of the liquid crystal display panel.

In particular, it is assumed that the relationship between grayscale voltage and luminance of the liquid crystal display panel obtained in advance is f(Lx, Vx), based on the target luminance Lx of each grayscale obtained from the above step 102, the required target grayscale voltage Vx of each grayscale can be calculated.

The relationship between grayscale voltage and luminance of the liquid crystal display panel obtained in advance can be obtained by measurement of an optical sensor. For example, using the optical sensor to measure luminance values of displayed images of the liquid crystal display panel at different grayscale voltages, and then obtaining the relationship between grayscale voltage and luminance of the liquid crystal display panel by calculation according to the different grayscale voltages and corresponding luminance values.

104: adjusting a grayscale voltage of each grayscale of the liquid crystal display panel to be the target grayscale voltage of the grayscale.

For example, the target grayscale voltage value of the grayscale x is sent to a TCON (timing controller) plate of the liquid crystal display panel, so as to adjust the grayscale voltage of the grayscale x of the liquid crystal display panel to be the foregoing obtained target grayscale voltage Vx required by the grayscale x, and thereby Gamma adjustment of the liquid crystal display panel is achieved.

This embodiment uses the optical sensor to measure the luminance values of the liquid crystal display panel displaying the maximum grayscale image and the minimum grayscale image so as to obtain the target luminance of each grayscale of the liquid crystal display panel, and further obtains the required grayscale voltage of each grayscale of the liquid crystal display panel based on the relationship between grayscale voltage and luminance of the liquid crystal display panel measured by the optical sensor. As a result, the automatic adjustment of display parameter Gamma is achieved.

Figure 2:
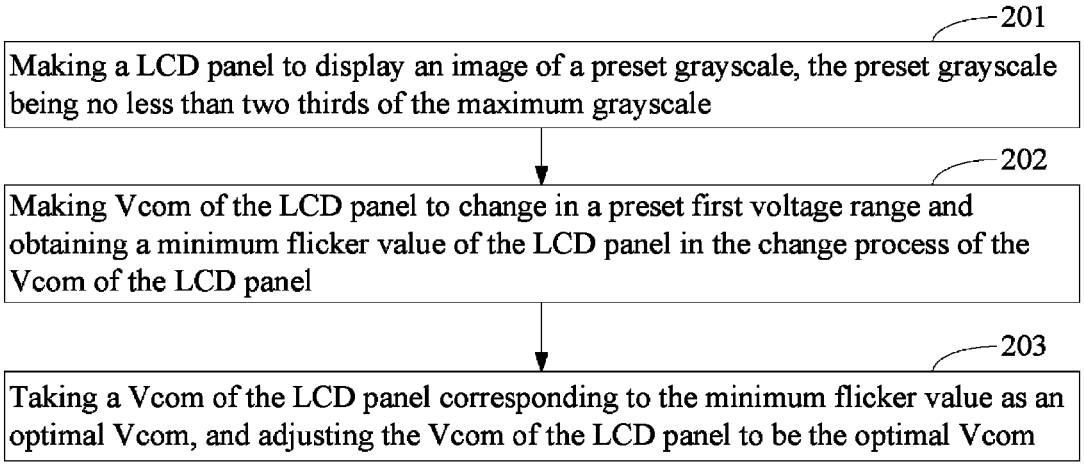
FIG. 2 is a part of flowchart of another embodiment of the adjusting method of display parameter of the present application.

Referring to FIG. 2, FIG. 2 is a part of a flowchart of another embodiment of the adjusting method of display parameter of the present application. In order to more accurately adjust display parameters such as Gamma and flicker value of the liquid crystal display panel, this embodiment firstly adjusts a common voltage Vcom of the liquid crystal display panel to be an optimal value before adjusting the Gamma of the liquid crystal display panel. Specifically, the method includes the steps as shown in FIG. 1, and before performing the steps as shown in FIG. 1, firstly performs the following steps 201-203 in FIG. 2:

201: making the display panel display a preset grayscale of image, the preset grayscale being no less than two thirds of the maximum grayscale.

For example, the pattern generator is firstly enabled to generate a grayscale signal of a preset grayscale and send the signal of the preset grayscale to the liquid crystal display panel to make the liquid crystal display panel to display a corresponding grayscale image. The setting of the preset grayscale can be set by user or is system default. Generally, the preset grayscale is no less than two thirds of the maximum grayscale, so as to ensure subsequent measurement accuracy of flicker value of the liquid crystal display panel. According to a positive proportional relationship between luminance and grayscale of the liquid crystal display panel, the larger the grayscale of the generated image is, the greater the luminance of the liquid crystal display panel is, and at this time, the measured flicker value of the liquid crystal display panel is more accurate. In a preferred embodiment, it may be that to make the liquid crystal display panel to generate the maximum grayscale image, and at this time, the luminance of the liquid crystal display panel is the maximum, and therefore the measured flicker value of the liquid crystal display panel is most accurate.

202: making a common voltage (Vcom for short) of the liquid crystal display panel to change in a preset first voltage range and obtaining a minimum flicker value of the liquid crystal display panel in the change process of the Vcom of the liquid crystal display panel.

Figure 3:
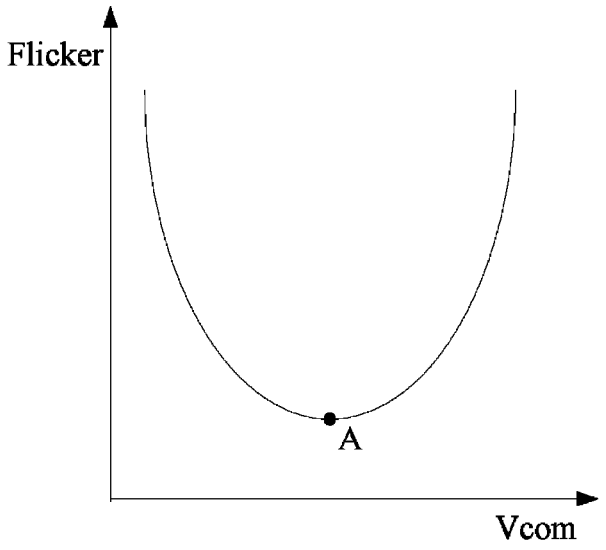
FIG. 3 is a schematic diagram of relationship between Vcom of liquid crystal display panel and flicker value of liquid crystal display panel in the embodiment as shown in FIG. 2.

After the liquid crystal display panel displays the preset grayscale image, the Vcom of the liquid crystal display panel is adjusted so as to make the Vcom of the liquid crystal display panel to change from high to low or from low to high in the preset first voltage range. In the change process of Vcom, an optical sensor is used to measure luminance values of the liquid crystal display panel so as to obtain corresponding flicker values of the liquid crystal display panel in the change process of Vcom, as shown in FIG. 3. A minimum flicker value of the liquid crystal display panel found from the obtained flicker values of the liquid crystal display panel in the change process is the minimum flicker value as denoted by point A in FIG. 3.

The preset first voltage range may be from an allowable maximum Vcom of the liquid crystal display panel to an allowable minimum Vcom of the liquid crystal display panel.

203: taking a Vcom of the liquid crystal display panel corresponding to the minimum flicker value as an optimal Vcom, and adjusting the Vcom of the liquid crystal display panel to be the optimal Vcom.

In particular, a Vcom corresponding to the above found minimum flicker value is obtained, e.g., the Vcom corresponding to the point A in FIG. 3, and the Vcom is taken as the optimal Vcom of the liquid crystal display panel. The value of the optimal Vcom is sent to a TCON plate of the liquid crystal display panel, so as to adjust the Vcom of the liquid crystal display panel to be the optimal Vcom.

In addition, before adjusting the Gamma, this embodiment performs Vcom optimal adjustment, so that the accuracy of subsequent adjustment of display parameter is improved.

Figure 4:
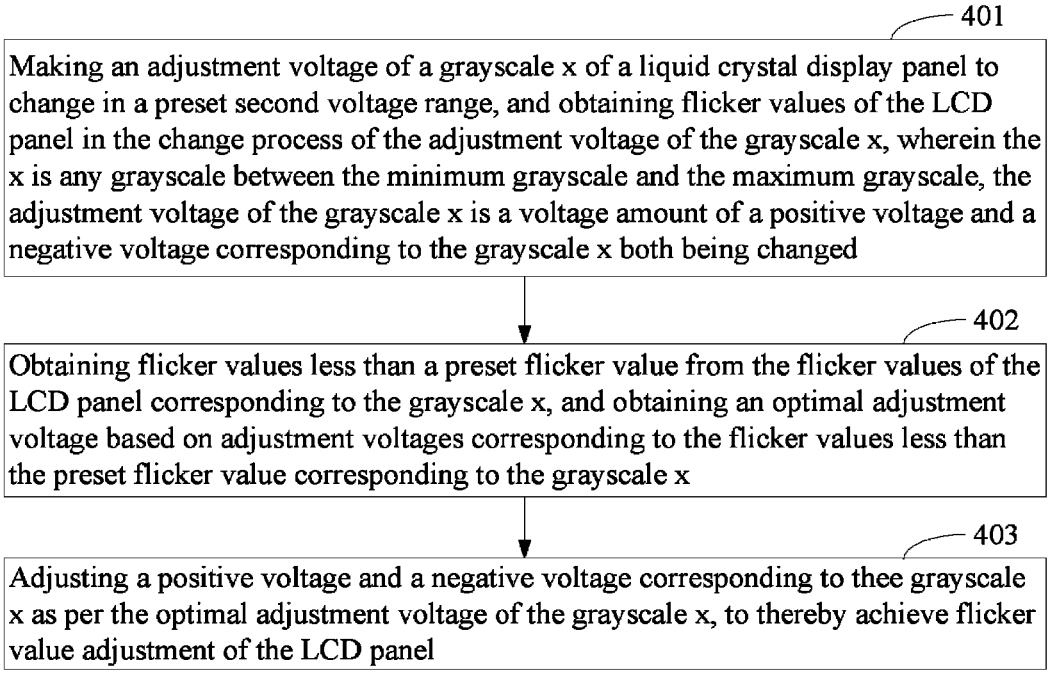
FIG. 4 is a flowchart of still another embodiment of the adjusting method of display parameter of the present application.

Referring to FIG. 4, FIG. 4 is a flowchart of still another embodiment of the adjusting method of display parameter of the present application. In this embodiment, a display parameter required to be adjusted is a flicker value of a liquid crystal display panel. The adjusting method includes the following steps 401-403:

401: making an adjustment voltage $\Delta V_x$ of a grayscale x of the liquid crystal display panel to change in a preset second voltage range and obtaining flicker values $F(\Delta V_x)$ of the liquid crystal display panel in the change process of the adjustment voltage of the grayscale x, wherein the x is any grayscale between the minimum grayscale and the maximum grayscale, the adjustment voltage $\Delta V_x$ of the grayscale x is a voltage amount of a positive voltage and a negative voltage corresponding to the grayscale x both being changed.

When any one grayscale x is taken as an example, a grayscale voltage of the grayscale x of the liquid crystal display panel is constituted by a positive voltage $V_{x+}$ and a negative voltage $V_{x-}$, and the adjustment voltage $\Delta V_x$ of the grayscale x is defined as a voltage amount of the positive voltage $V_{x+}$ and the negative voltage $V_{x-}$ corresponding to the grayscale x both being changed. The positive voltage $V_{x+}$ and the negative voltage $V_{x-}$, corresponding to the grayscale x of the liquid crystal display panel are made to be changed with a same voltage amount, so as to ensure the display luminance of the liquid crystal display panel at the grayscale x to be unchanged. A process of changing the voltage amount is that the adjustment voltage $\Delta V_x$ changes from high to low or from low to high in the preset second voltage range. Concretely for example, the adjustment voltage from a preset minimum value, is successively increased with a minimum variable voltage (minimum voltage resolution) until a preset maximum value, and after each step of adjustment of the positive and negative voltages of the grayscale x, an optical sensor is used to measure a luminance value of the liquid crystal display panel at this time, so as to obtain a flicker value of the liquid crystal display panel at this time, and thereby the flicker values $F(\Delta V_x)$ of the liquid crystal display panel in the change process of the adjustment voltage of the grayscale x are obtained.

By performing the above operation for each grayscale of the liquid crystal display panel, the flicker values of the liquid crystal display panel in the change process of the adjustment voltage of each grayscale can be obtained.

402: obtaining flicker values $F(\Delta V'_x)$ less than a preset flicker value from the flicker values $F(\Delta V_x)$ of the liquid crystal display panel corresponding to the grayscale x and obtaining an optimal adjustment voltage of the grayscale x based on adjustment voltages $\Delta V'_x$ corresponding to the flicker values $F(\Delta V'_x)$ of the grayscale x.

Figure 5:
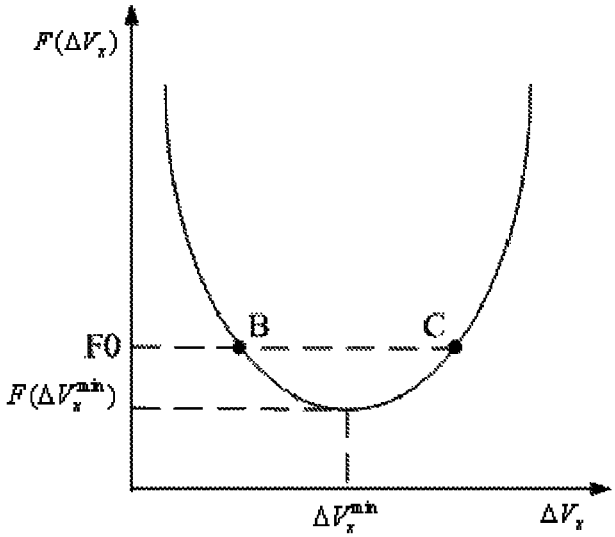
FIG. 5 is a schematic diagram of relationship between adjustment voltage of a grayscale x of liquid crystal display panel and flicker value of liquid crystal display panel in the embodiment as shown in FIG. 4.

Continuing to take any one grayscale x as an example, the flicker values $F(\Delta V_x)$ of the liquid crystal display panel corresponding to the grayscale x are obtained from the above step 401, as shown in FIG. 5, flicker values $F(\Delta V'_x)$ less than a preset flicker value F0 are found out from the flicker values $F(\Delta V_x)$. The preset flicker value may be any flicker value greater than a minimum value of the flicker values of the liquid crystal display panel and less than a half of a maximum value of the flicker values of the liquid crystal display panel.

After finding out the flicker values $F(\Delta V'_x)$ less than the preset flicker value F0 corresponding to the grayscale x, adjustment voltages $\Delta V'_x$ corresponding to the flicker values $F(\Delta V'_x)$ less than the preset flicker value F0 can be obtained, i.e., horizontal axis voltage values between point B and point C in FIG. 5, and then an average value of the obtained adjustment voltages $\Delta V'_x$ is calculated as the optical adjustment voltage or one voltage value of the adjustment voltages $\Delta V'_x$ is taken as the optical adjustment voltage.

Preferably, it may be that directly obtaining a minimum flicker value $F(\Delta V_x^{min})$ in the flicker values $F(\Delta V_x)$ of the liquid crystal display panel corresponding to the grayscale x and obtaining an adjustment voltage $\Delta V_x^{min}$ corresponding to the minimum flicker value $F(\Delta V_x^{min})$ as the optical adjustment voltage of the grayscale x. Because the adjustment relationship between the flicker values of the liquid crystal display panel and corresponding adjustment voltages is as shown in FIG. 5, and therefore at this time, by adjusting the grayscale voltage of the grayscale x based on the adjustment voltage corresponding to the minimum flicker value, the optimal adjustment of flicker value of the liquid crystal display panel can be realized.

By performing the above operation for each grayscale of the liquid crystal display panel, the optimal adjustment voltage of each grayscale can be obtained.

403: adjusting the positive voltage and the negative voltage corresponding to the grayscale x as per the optimal adjustment voltage of the grayscale x, to thereby achieve flicker value adjustment of the liquid crystal display panel.

Continuing to take any one grayscale x as an example, the optimal adjustment voltage of the grayscale x obtained from the above step 402 is sent to the TCON plate of the liquid crystal display panel, so as to adjust the positive voltage and the negative voltage corresponding to the grayscale x of the liquid crystal display panel, so that the change amounts of both the positive voltage and the negative voltage corresponding to the grayscale x are equal to the optimal adjustment voltage of the grayscale x.

By performing the above operation for each grayscale of the liquid crystal display panel, the positive and negative voltages of each grayscale can be adjusted. At this time, because the change amounts of the positive voltage and the negative voltage of each grayscale are the same, a voltage difference between the positive voltage and the negative voltage is not changed, i.e., the grayscale voltage is not changed, and therefore the luminance of each grayscale of the liquid crystal display panel would be not changed, and flicker value adjustment of the liquid crystal display panel is realized as a result.

In a preferred embodiment, before adjusting the flicker value of the liquid crystal display panel, the Vcom of the liquid crystal display panel is firstly adjusted, i.e., firstly performing steps 201-203 as shown in FIG. 2, and then performing the steps 401-403 as shown in FIG. 4. For details, please refer to the above description and thus will not be repeated herein.

In another preferred embodiment, both the adjustments of Gamma and flicker value of the liquid crystal display panel are performed, i.e., the method in this embodiment includes the steps 101-104 as shown in FIG. 1 as well as the steps 401-403 as shown in FIG. 4. More preferably, before adjusting the Gamma and flicker value of the liquid crystal display panel, the adjustment of Vcom of the liquid crystal display panel is firstly performed, i.e., firstly performing the steps 201-203 as shown in FIG. 2 and then performing the steps 101-104 as shown in FIG. 1 as well as the steps 401-403 as shown in FIG. 4. For details, please refer to the above description and thus will not be repeated herein.

Figure 6:
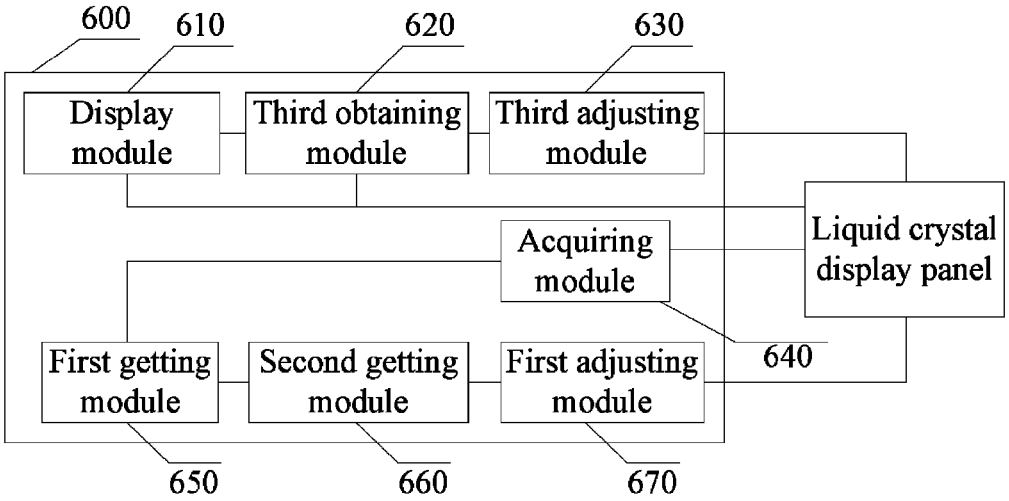
FIG. 6 is a schematic structural view of an embodiment of an adjusting apparatus of display parameter of the present application.

Referring to FIG. 6, FIG. 6 is a schematic structural view of an embodiment of an adjusting apparatus of display parameter of the present application. In this embodiment, the display parameter required to be adjusted is Gamma of a liquid crystal display panel. The adjusting apparatus of display parameter 600 includes a display module 610, a third obtaining module 620, a third adjusting module 630, an acquiring module 640, a first getting module 650, a second getting module 660 and a first adjusting module 670.

The display module 610 is configured (i.e., structured and arranged) for making a liquid crystal display panel to display an image of a preset grayscale. The preset grayscale is no less than two thirds of a maximum grayscale of the liquid crystal display panel.

For example, the adjusting apparatus of display parameter 600 further includes a pattern generator (not shown). The display module 610 enables the pattern generator to generate a grayscale signal of the preset grayscale, and then the signal of the preset grayscale is sent to the liquid crystal display panel to make the liquid crystal display panel to display a corresponding grayscale image. Generally, the preset grayscale is no less than two thirds of the maximum grayscale, so as to assure subsequent measurement accuracy of flicker value of the liquid crystal display panel. In a preferred embodiment, it may be that to make the liquid crystal display panel to generate a maximum grayscale image, and at this time, a luminance of the liquid crystal display panel is maximum, i.e., a measured flicker value of the liquid crystal display panel is most accurate.

The third obtaining module 620 is configured for making a Vcom of the liquid crystal display panel to change in a preset first voltage range and obtaining a minimum flicker value of the liquid crystal display panel in the change process of the Vcom of the liquid crystal display panel.

In particular, after the liquid crystal display panel displays the preset grayscale image, the third obtaining module 620 adjusts the Vcom of the liquid crystal display panel to make the Vcom of the liquid crystal display panel to change from high to low or from low to high in the preset first voltage range, and an optical sensor is used to obtain corresponding flicker values of the liquid crystal display panel in the change process. A minimum flicker value of the liquid crystal display panel found from the obtained flicker values of the liquid crystal display panel in the change process is the minimum flicker value, and the minimum flicker value is sent to the third adjusting module 630. The preset first voltage range may be from an allowable maximum Vcom of the liquid crystal display panel to an allowable minimum Vcom of the liquid crystal display panel.

The third adjusting module 630 is configured for taking a Vcom of the liquid crystal display panel corresponding to the minimum flicker value as an optimal Vcom and adjusting the Vcom of the liquid crystal display panel to be the optimal Vcom.

In particular, the third adjusting module 630 acquires the Vcom corresponding to the foregoing found minimum flicker value and takes the Vcom as the optimal Vcom of the liquid crystal display panel. A value of the optimal Vcom is sent to a TCON plate of the liquid crystal display panel, so as to adjust the Vcom of the liquid crystal display panel to be the optimal Vcom.

The acquiring module 640 is configured for acquiring a first luminance value when the liquid crystal display panel displaying an image of a minimum grayscale and acquiring a second luminance value when the liquid crystal display panel displaying an image of a maximum grayscale.

For example, the acquiring module 640 enables the pattern generator to generate a signal of a minimum grayscale and input the signal to the liquid crystal display panel to make the liquid crystal display panel to display the image of the minimum grayscale, and an optical sensor is used to measure a luminance of the liquid crystal display panel at this time as the first luminance value. Moreover, the acquiring module 640 further enables the pattern generator to a signal of a maximum grayscale and input the signal to the liquid crystal display panel to make the liquid crystal display panel to display the image of the maximum grayscale, and the optical sensor is used to measure a luminance of the liquid crystal display panel at this time as the second luminance value. The acquiring module 640 sends the first luminance value and the second luminance value to the first getting module 650.

The first getting module 650 is configured for getting a target luminance value of each grayscale conforming to a standard Gamma curve based on the first luminance value, the luminance value and the standard Gamma curve of the liquid crystal display panel.

For example, the first getting module 650 gets the target luminance value of each grayscale conforming to the standard Gamma curve based on the first luminance value, the second luminance value and an expression (1), and further sends the target luminance value of each grayscale to the second getting module 660. The expression (1) concretely is as follows:

$$\frac{L_x - L_{min}}{L_{max} - L_{min}} = \left(\frac{x}{G_{max}}\right)^{\gamma} \quad (1)$$

where $L_x$ is a calculated target luminance value of the grayscale x, $L_{min}$ is the first luminance value, L is the second luminance value, the x is any grayscale between the minimum grayscale and the maximum grayscale, $G_{max}$ is the maximum grayscale, γ is a standard Gamma value of the liquid crystal display panel.

The second getting module 660 is configured for getting a target grayscale voltage of each grayscale of the liquid crystal display panel based on the target luminance value of each grayscale and a relationship between grayscale voltage and luminance of the liquid crystal display panel obtained in advance.

Specifically, it is assumed that the relationship between grayscale voltage and luminance of the liquid crystal display panel obtained in advance is f(x), the second getting module 660 can calculate the required target grayscale voltage Vx of the grayscale x based on the above obtained target luminance value Lx of the grayscale x and further send the target grayscale voltage Vx of the grayscale x to the first adjusting module 670.

The relationship between grayscale voltage and luminance of the liquid crystal display panel obtained in advance can be obtained by measurement of optical sensor. Concretely for example, an optical sensor is used to measure luminance values of displayed images of the liquid crystal display panel at different grayscale voltages, and then the relationship between grayscale voltage and luminance can be obtained by calculation based on the different grayscale voltage and the corresponding luminance values.

The first adjusting module 670 is configured for adjusting the grayscale voltage of each grayscale of the liquid crystal display panel to be the target grayscale voltage of the grayscale.

In particular, the first adjusting module 670 adjusts the grayscale voltage of the grayscale x of the liquid crystal display panel to be the foregoing obtained target grayscale voltage Vx required by the grayscale, and thereby the Gamma adjustment of the liquid crystal display panel is realized as a result.

This embodiment uses the optical sensor to measure the luminance values when the liquid crystal display panel displaying the maximum grayscale image and the minimum grayscale image respectively, and obtains required grayscale voltage of each grayscale of the liquid crystal display panel based on the relationship between grayscale voltage and luminance of the liquid crystal display panel obtained by measurement of optical sensor, and thereby automatic adjustment of the display parameter Gamma is realized as a result. In addition, before adjusting the Gamma, this embodiment performs the Vcom optimal adjustment, and therefore the accuracy of subsequent display parameter adjustment is increased.

Of course, in other embodiment, the adjusting apparatus of display parameter may not perform the Vcom optimal adjustment before adjusting Gamma, i.e., does not include the above display module 610, the third obtaining module 620 and the third adjusting module 630, which still can realize automatic adjustment of Gamma, but the accuracy of Gamma adjustment may be not as good as that in above embodiment.

Figure 7:
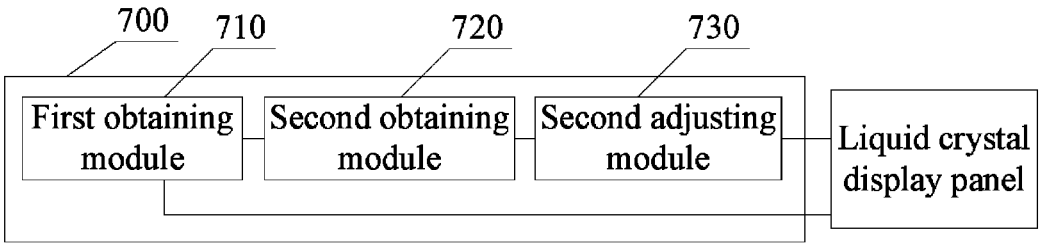
FIG. 7 is a schematic structural view of another embodiment of the adjusting apparatus of display parameter of the present application.

Referring to FIG. 7, FIG. 7 is a schematic structural view of another embodiment of the adjusting apparatus of display parameter of the present application. In this embodiment, a display parameter required to be adjusted is a flicker value of a liquid crystal display panel. The adjusting apparatus 700 of a display parameter includes a first obtaining module 710, a second obtaining module 720 and a second adjusting module 730.

The first obtaining module 710 is configured for making an adjustment voltage $\Delta V_x$ for a grayscale x of the liquid crystal display panel to change in a preset second voltage range and obtaining flicker values $F(\Delta V_x)$ of the liquid crystal display panel in the change process of the adjustment value $\Delta V_x$ of the grayscale x. The x is any grayscale between the minimum grayscale and the maximum grayscale. The adjustment value $\Delta V_x$ of the grayscale x is a voltage amount of a positive voltage and a negative voltage corresponding to the grayscale x being both changed.

When any grayscale x is taken as an example, a grayscale voltage of the grayscale x of the liquid crystal display panel is constituted by a positive voltage $V_{x+}$ and a negative voltage $V_{x-}$. The adjustment voltage $\Delta V_x$ of the grayscale x is defined as the voltage amount of the positive voltage $V_{x+}$ and the negative voltage $V_{x-}$ corresponding to the grayscale x both being changed. The first obtaining module 710 makes the positive voltage $V_{x+}$ and the negative voltage $V_{x-}$ corresponding to the grayscale x of the liquid crystal display panel to be changed with a same voltage change amount, so as to ensure the display luminance of the liquid crystal display panel being unchanged. A process of changing the voltage amount is that the adjustment voltage $\Delta V_x$ changes from high to low or from low to high in the preset second voltage range, and after each time of the change of the positive and negative voltages of the grayscale x, an optical sensor is used to measure a luminance value of the liquid crystal display panel at this time so as to obtain a flicker value of the liquid crystal display panel at this time, and thereby flicker values $F(\Delta V_x)$ of the liquid crystal display panel in the change process of the adjustment voltage of the grayscale x can be obtained.

The first obtaining module 710 performs the above operation for each grayscale of the liquid crystal display panel, and thereby the flicker values of the liquid crystal display panel for each grayscale in the change process of the adjustment voltage can be obtained. The flicker values $F(\Delta V_x)$ of the liquid crystal display panel corresponding to the grayscale x are sent to the second obtaining module 720.

The second obtaining module 720 is configured for obtaining flicker values $F(\Delta V'_x)$ less than a preset flicker value from the flicker values $F(\Delta V_x)$ of the liquid crystal display panel corresponding to the grayscale x and obtaining an optimal adjustment voltage of the grayscale x based on adjustment voltages $\Delta V'_x$ corresponding to the flicker values $F(\Delta V'_x)$ of the grayscale x.

Continuing to take any one grayscale x as an example, the flicker values $F(\Delta V_x)$ of the liquid crystal display panel corresponding to the grayscale x are obtained from the first obtaining module 710, as shown in FIG. 5, the second obtaining module 720 find out the flicker values $F(\Delta V'_x)$ less than the preset flicker value F0 from the flicker values $F(\Delta V_x)$. The preset flicker value may be any flicker value greater than a minimum value of the flicker values of the liquid crystal display panel and less than a half of a maximum value of the flicker values of the liquid crystal display panel.

After finding out the flicker values $F(\Delta V'_x)$ less than the preset flicker value F0 and corresponding to the grayscale x, the second obtaining module 720 obtains adjustment voltages $\Delta V'_x$ corresponding to the flicker values $F(\Delta V'_x)$ less than the preset flicker value F0, i.e., horizontal axis voltage values between point B and point C in FIG. 5, and then calculates an average value of the adjustment voltages $\Delta V'_x$ as the optimal adjustment voltage or takes one voltage value of the adjustment voltages $\Delta V'_x$ as the optimal adjustment voltage.

Preferably, the second obtaining module 720 can directly obtain a minimum flicker value $F(\Delta V_x^{min})$ in the flicker values $F(\Delta V_x)$ of the liquid crystal display panel corresponding to the grayscale x and obtain an adjustment voltage $\Delta V_x^{min}$ corresponding to the minimum flicker value $F(\Delta V_x^{min})$ as the optimal adjustment voltage of the grayscale x. Because the adjustment relationship between flicker value of the liquid crystal display panel and grayscale voltage of the grayscale x is as shown in FIG. 5, by adjusting the grayscale voltage of the grayscale x based on the adjustment voltage corresponding to the minimum flicker value, the optimal adjustment of flicker value of the liquid crystal display panel can be achieved.

The second obtaining module 720 performs the above operation for each grayscale of the liquid crystal display panel, and thus the optimal adjustment voltage for each grayscale can be obtained. The second obtaining module 720 further sends the optimal adjustment voltage of the grayscale x to the second adjustment module 730.

The second adjusting module 730 is configured for adjusting the positive voltage and the negative voltage of the grayscale x based on the optimal adjustment voltage of the grayscale x, to thereby achieve the flicker value adjustment of the liquid crystal display panel.

Continuing to take any one grayscale x as an example, after obtaining the optimal adjustment voltage of the grayscale x from the second obtaining module 720, the second adjusting module 730 adjusts the positive voltage and the negative voltage corresponding to the grayscale x to make voltage change amounts of the positive voltage and the negative voltage corresponding to the grayscale x both are equal to the optimal adjustment voltage of the grayscale x.

The second adjusting module 730 performs the above operation for each grayscale of the liquid crystal display panel, so that the positive and negative voltages corresponding to each grayscale can be adjusted. At this situation, because the change amounts of the positive voltage and the negative voltage of each grayscale are the same, the voltage difference between the positive voltage and the negative voltage is not changed, i.e., the grayscale voltage is not changed, and therefore the luminance of each grayscale of the liquid crystal display panel would not be changed and the flicker value adjustment of the liquid crystal display panel is realized.

In a preferred embodiment, before adjusting the flicker value of the liquid crystal display panel, the adjusting apparatus of display parameter may firstly perform the adjustment to Vcom of the liquid crystal display panel, that is, the adjusting apparatus of display parameter not only includes the display module 610, the third obtaining module 620 and the third obtaining module 630, but also includes the first obtaining module 710, the second obtaining module 720 and the second adjusting module 730. For details, please refer to the above description, and thus will not be repeated herein.

In another preferred embodiment, the adjusting apparatus of display parameter may perform both the adjustment of Gamma and flicker value of the liquid crystal display panel, that is, the adjusting apparatus of display parameter not only includes the acquiring module 640, the first getting module 650, the second getting module 660 and the first adjusting module 670, but also includes the first obtaining module 710, the second obtaining module 720 and the second adjusting module 730. More preferably, before performing the adjustments of Gamma and flicker value of the liquid crystal display panel, Vcom adjustment of the liquid crystal display panel is firstly performed, that is, the adjusting apparatus of display parameter includes the display module 610, the third obtaining module 620, the third adjusting module 630, the acquiring module 640, the first getting module 650, the second getting module 660 and the first adjusting module 670 as well as the first obtaining module 710, the second obtaining module 720 and the second adjusting module 730. For details, please refer to the above description and thus will not be repeated herein.

Figure 8:
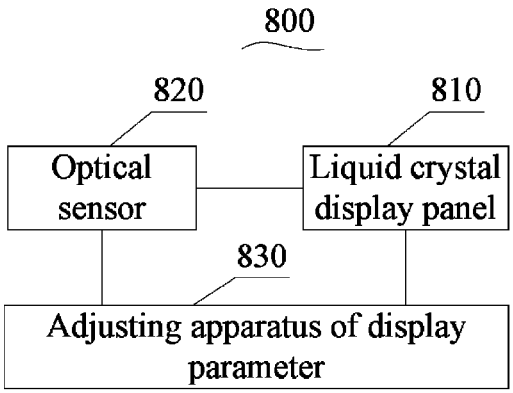
FIG. 8 is a schematic structural view of an embodiment of a liquid crystal display system of the present application.

Referring to FIG. 8, FIG. 8 is a schematic structural view of an embodiment of a liquid crystal display system of the present application. In this embodiment, the liquid crystal display system 800 includes a liquid crystal display panel 810, an optical sensor 820 and an adjusting apparatus of display parameter 830.

The optical sensor 820 is configured for acquiring luminance information of the liquid crystal display panel 810.

The luminance information of the liquid crystal display panel 810 includes a luminance value and a flicker value of the liquid crystal display panel 810.

The adjusting apparatus of display parameter 830 is configured for adjusting a display parameter(s) of the liquid crystal display panel 810 based on the luminance information obtained by the optical sensor 820. The adjusting apparatus of display parameter 830 concretely is any one of the adjusting apparatuses of display parameter in above embodiments.

In addition, the above adjusting apparatus of display parameter may further include the optical sensor for acquiring the luminance value and/or the flicker value of the liquid crystal display panel.

The above liquid crystal display panel may be but not limited to a thin film transistor liquid crystal display device (TFT-LCD for short).

In the above solution, by using the optical sensor to measure the luminance information of the liquid crystal display panel and then adjusting the grayscale voltage of each grayscale of the liquid crystal display panel based on the luminance information of the liquid crystal display panel, automatic adjustments of the display parameters such as Gamma and flicker value of the liquid crystal display panel can be achieved.

In the various embodiments provided by the present application, it should be understood that, the disclosed system, apparatus and method can be implemented by other manner. For example, the above described apparatus embodiments are merely illustrative, e.g., the division of modules and units only is a division of logic functions, and may have other dividing manner in actual implementation, for example multiple units or modules can be combined or can be integrated into another system, or some features may be omitted or not implemented. In another aspect, the displayed or discussed mutual coupling, direct coupling or communication connection may be implemented by some interface; indirect coupling or communication connection of apparatuses or units may be electrical, mechanical or other manner.

The units or modules described as separated components may be or may not be physically separated, the components illustrated as units or modules may be or may not be physical units, i.e., may be located in one place or distributed to multiple network units. It may be that selecting some or all of the units to achieve the purpose of the solution of the present embodiment according to actual requirement.

In addition, the functional units or modules in the various embodiments of the present application may be integrated into one processor or more than one processor, or the functional units or modules are individually physically presented, or two or more than two units or modules are integrated into one unit. The above integrated units or modules not only can be implemented in the form of hardware, but also can be implemented in the form of software.

The integrated units or modules if are implemented as software functional units or modules and as an individual product for sale or use, it may be stored in a computer readable storage medium. Based on this understanding, the technical solution of the present application basically or the part of making a contribution to the art or a part or all of the technical solution may be embodied by the form of software product. The computer software product is stored in a storage medium and includes several instructions to make a computer device (may be a personal computer, a server or a network equipment, etc.) or a processor to execute all or part of the steps of the methods of the various embodiments of the present application. The storage medium may be one of various mediums can store program codes such as a U disk, a portal hard disk, a read-only memory (ROM), a random access memory (RAM), a magnetic disk and an optical disk.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An adjusting method of both Gamma and flicker value of a liquid crystal display panel, comprising obtaining a first luminance value when the liquid crystal display panel is displaying an image of a minimum grayscale and a second luminance value when the liquid crystal display panel is displaying an image of a maximum grayscale;

based on the first luminance value, the second luminance value and a standard Gamma curve of the liquid crystal display panel, obtaining a target luminance value of each grayscale conforming to the standard Gamma curve;

based on the target luminance value of each grayscale and a predetermined relationship between grayscale voltage and luminance of the liquid crystal display panel, obtaining a target grayscale voltage of each grayscale of the liquid crystal display panel;

adjusting a grayscale voltage of each grayscale of the liquid crystal display panel to be the target grayscale voltage of the grayscale, to thereby achieve Gamma adjustment of the liquid crystal display panel;

making an adjustment voltage $\Delta V_x$ of a grayscale x of the liquid crystal display panel to change in a preset second voltage range and obtaining flicker values $F(\Delta V_x)$ of the grayscale x in a process of making the adjustment voltage $\Delta V_x$ of the grayscale x of the liquid crystal display panel to change in the preset second voltage range, wherein the x is any grayscale in a range from the minimum grayscale to the maximum grayscale, the adjustment voltage $\Delta V_x$ of the grayscale x is a voltage amount of a positive voltage and a negative voltage corresponding to the grayscale x both being changed;

obtaining flicker values $F(\Delta V'_x)$ less than a preset flicker value from the flicker values $F(\Delta V_x)$ of the grayscale x, and obtaining an optimal adjustment voltage of the grayscale x based on adjustment voltages $\Delta V'_x$ corresponding to the flicker values $F(\Delta V'_x)$ of the grayscale x;

adjusting the positive voltage and the negative voltage corresponding to the grayscale x as per the optimal adjustment voltage of the grayscale x, to thereby achieve flicker value adjustment of the liquid crystal display panel; wherein a grayscale voltage of the grayscale x is constituted by the positive voltage and the negative voltage, the positive voltage and the negative voltage both are adjusted with the same voltage amount equal to the optimal adjustment voltage such that the grayscale voltage of the grayscale x being the voltage difference between the positive voltage and the negative voltage is not changed;

before the step of obtaining a first luminance value when the liquid crystal display panel is displaying an image of a minimum grayscale and a second luminance value when the liquid crystal display panel is displaying an image of a maximum grayscale, further comprising:

making the liquid crystal display panel to display an image of a preset grayscale, wherein the preset grayscale is no less than two thirds of the maximum grayscale;

making a common voltage Vcom of the liquid crystal display panel to change in a preset first voltage range and obtaining a minimum flicker value of the liquid crystal display panel in a change process of the Vcom of the liquid crystal display panel, wherein the preset first voltage range is from an allowable maximum common voltage of the liquid crystal display panel to an allowable minimum common voltage of the liquid crystal display panel;

taking a Vcom of the liquid crystal display panel corresponding to the minimum flicker value as an optimal Vcom, and adjusting the Vcom of the liquid crystal display panel to be the optimal Vcom.

2. The adjusting method of both Gamma and flicker value of a liquid crystal display panel as claimed in claim 1, wherein the step of based on the first luminance value, the second luminance value and a standard Gamma curve of the liquid crystal display panel, obtaining a target luminance value of each grayscale conforming to the standard Gamma curve comprises:

based on the first luminance value, the second luminance value and an expression (1), obtaining the target luminance value of each grayscale conforming to the standard Gamma curve, wherein the expression (1) is:

$$\frac{L_x - L_{min}}{L_{max} - L_{min}} = \left(\frac{x}{G_{max}}\right)^{\gamma} \quad (1)$$

where $L_x$ is a calculated target luminance value of a grayscale x, $L_{min}$ is the first luminance value, $L_{max}$ is the second luminance value, x is any grayscale between the minimum grayscale and the maximum grayscale, $G_{max}$ is the maximum grayscale, γ is a standard Gamma value of the liquid crystal display panel.

3. The adjusting method of both Gamma and flicker value of a liquid crystal display panel as claimed in claim 1, wherein the step of obtaining flicker values $F(\Delta V'_x)$ less than a preset flicker value from the flicker values $F(\Delta_x)$ of the grayscale x, and obtaining an optimal adjustment voltage of the grayscale x based on adjustment voltages $\Delta V'_x$ corresponding to the flicker values $F(\Delta V'_x)$ of the grayscale x comprises:

obtaining a minimum flicker value $F(\Delta V_x^{min})$ from the flicker values $F(\Delta V_x)$ of the liquid crystal display panel corresponding to the grayscale x, and taking an adjustment voltage $\Delta V_x^{min}$ corresponding to the minimum flicker value $F(\Delta V_x^{min})$ as the optimal adjustment voltage of the grayscale x.

4. The adjusting method of both Gamma and flicker value of a liquid crystal display panel as claimed in claim 1, wherein the step of obtaining flicker values $F(\Delta V'_x)$ less than a preset flicker value from the flicker values $F(\Delta V_x)$ of the grayscale x, and obtaining an optimal adjustment voltage of the grayscale x based on adjustment voltages $\Delta V'_x$ corresponding to the flicker values $F(\Delta V'_x)$ of the grayscale x comprises:

calculating an average value of adjustment voltages $\Delta V'_x$ corresponding to the flicker values $F(\Delta V'_x)$ less than the preset flicker value as the optimal adjustment voltage, wherein the preset flicker value is greater than a minimum value of the flicker values $F(\Delta V_x)$ of the liquid crystal display panel and less than a half of a maximum value of the flicker values $F(\Delta V_x)$ of the liquid crystal display panel.

5. An adjusting method of flicker value of a liquid crystal display panel, comprising:

making an adjustment voltage $\Delta V_x$ of a grayscale x of a liquid crystal display panel to change in a preset second voltage range and obtaining flicker values $F(\Delta V_x)$ of the liquid crystal grayscale x in a process of making the adjustment voltage $\Delta V_x$ of the grayscale x of the liquid crystal display panel to change in the preset second voltage range, wherein the x is any grayscale in a range from a minimum grayscale to a maximum grayscale, the adjustment voltage $\Delta V_x$ of the grayscale x is a voltage amount of a positive voltage and a negative voltage corresponding to the grayscale x both being changed;

obtaining flicker values $F(\Delta V'_x)$ less than a preset flicker value from the flicker values $F(\Delta V_x)$ of the grayscale x, and obtaining an optimal adjustment voltage of the grayscale x based on adjustment voltages $\Delta V'_x$ corresponding to flicker values $F(\Delta V'_x)$ of the grayscale x;

adjusting the positive voltage and the negative voltage corresponding to the grayscale x as per the optimal adjustment voltage of the grayscale x, to thereby achieve flicker value adjustment of the liquid crystal display panel; wherein a grayscale voltage of the grayscale x is constituted by the positive voltage and the negative voltage, the positive voltage and the negative voltage both are adjusted with the same voltage amount equal to the optimal adjustment voltage such that the grayscale voltage of the grayscale x being the voltage difference between the positive voltage and the negative voltage is not changed;

wherein the step of obtaining flicker values $F(\Delta V'_x)$ less than a preset flicker value from the flicker values $F(\Delta V_x)$ of the grayscale x, and obtaining an optimal adjustment voltage of the grayscale x based on adjustment voltages $\Delta V'_x$ corresponding to the flicker values $F(\Delta V'_x)$ of the grayscale x comprises:

calculating an average value of adjustment voltages $\Delta V'_x$ corresponding to the flicker values $F(\Delta V'_x)$ less than the preset flicker value as the optimal adjustment voltage, wherein the preset flicker value is greater than a minimum value of the flicker values $F(\Delta V_x)$ of the liquid crystal display panel and less than a half of a maximum value of the flicker values $F(\Delta V_x)$ of the liquid crystal display panel.

6. The adjusting method of flicker value of a liquid crystal display panel as claimed in claim 5, before the step of making an adjustment voltage $\Delta V_x$ of a grayscale x of a liquid crystal display panel to change in a preset second voltage range and obtaining flicker values $F(\Delta V_x)$ of the grayscale x in a process of making the adjustment voltage $\Delta V_x$ of the grayscale x of the liquid crystal display panel to change in the preset second voltage range, further comprising:

making the liquid crystal display panel to display an image of a preset grayscale, wherein the preset grayscale is no less than two thirds of the maximum grayscale;

making a common voltage Vcom of the liquid crystal display panel to change in a preset first voltage range and obtaining a minimum flicker value of the liquid crystal display panel in a change process of the Vcom of the liquid crystal display panel;

taking a Vcom of the liquid crystal display panel corresponding to the minimum flicker value as an optimal Vcom, and adjusting the Vcom of the liquid crystal display panel to be the optimal Vcom.

7. A liquid crystal display system comprising a liquid crystal panel, an optical sensor, a storage medium and one or more than one processors;

the optical sensor being configured for acquiring luminance information of the liquid crystal display panel, wherein the luminance information of the liquid crystal display panel comprises a luminance value and a flicker value of the liquid crystal display panel;

wherein the storage medium being stored with a software production executable by the one or more than one processors to:

acquire a first luminance value from the optical sensor when the liquid crystal display panel is displaying an image of a minimum grayscale and a second luminance value from the optical sensor when the liquid crystal display panel is displaying an image of a maximum grayscale;

based on the first luminance value, the second luminance value and a standard Gamma curve of the liquid crystal display panel, obtain a target luminance value of each grayscale conforming to the standard Gamma curve;

based on the target luminance value of each grayscale and a predetermined relationship between grayscale voltage and luminance of the liquid crystal display panel, obtain an target grayscale voltage of each grayscale;

adjust a grayscale voltage of each grayscale of the liquid crystal display panel to be the target grayscale voltage of the grayscale, to thereby achieve Gamma adjustment of the liquid crystal display panel;

make an adjustment voltage $\Delta V_x$ of a grayscale x of the liquid crystal display panel to change in a preset second voltage range, obtain flicker values $F(\Delta V_x)$ of the grayscale x in a change process of the adjustment voltage $\Delta V_x$ of the grayscale x in the preset second voltage range, the x is any grayscale in a range from the minimum grayscale to the maximum grayscale, the adjustment voltage $\Delta V_x$ of the grayscale x is a voltage amount of a positive voltage and a negative voltage corresponding to the grayscale x both being changed;

obtain flicker values $F(\Delta V'_x)$ less than a preset flicker value from the flicker values $F(\Delta V'_x)$ of the grayscale x and get an optimal adjustment voltage of the grayscale x based on adjustment voltages $\Delta V'_x$ corresponding to the flicker values $F(\Delta V'_x)$ of the grayscale x;

adjust the positive voltage and the negative voltage corresponding to the grayscale x as per the optimal adjustment voltage of the grayscale x, to thereby achieve flicker value adjustment of the liquid crystal display panel;

wherein a grayscale voltage of the grayscale x is constituted by the positive voltage and the negative voltage, the positive voltage and the negative voltage both are adjusted with the same voltage amount equal to the optimal adjustment voltage such that the grayscale voltage of the grayscale x being the voltage difference between the positive voltage and the negative voltage is not change;

make the liquid crystal display panel to display an image of a preset grayscale, the preset grayscale being no less than two thirds of the maximum grayscale;

make a common voltage Vcom of the liquid crystal display panel to change in a preset first voltage range and obtain a minimum flicker value of the liquid crystal display panel in a change process of the Vcom of the liquid crystal display panel, wherein the preset first voltage range is from an allowable maximum common voltage of the liquid crystal display panel to an allowable minimum common voltage of the liquid crystal display panel;

take a Vcom of the liquid crystal display panel corresponding to the minimum flicker value as an optimal Vcom and further adjust the Vcom of the liquid crystal display panel to be the optimal Vcom.

8. The liquid crystal display system as claimed in claim 7, wherein based on the first luminance value, the second luminance value and a standard Gamma curve of the liquid crystal display panel, obtain a target luminance value of each grayscale conforming to the standard Gamma curve comprises:

based on the first luminance value, the second luminance value and an expression (1), obtain the target luminance value of each grayscale conforming to the standard Gamma curve, the expression (1) is as follows:

$$\frac{L_x - L_{min}}{L_{max} - L_{min}} = \left(\frac{x}{G_{max}}\right)^{\gamma} \tag{1}$$

where $L_x$ is a calculated target luminance value of the grayscale x, $L_{min}$ is the first luminance value, $L_{max}$ is the second luminance value, x is any grayscale between the minimum grayscale and the maximum grayscale, $G_{max}$ is the maximum grayscale, and $\gamma$ is a standard Gamma value of the liquid crystal display panel.

9. The liquid crystal display system as claimed in claim 7, wherein obtain flicker values $F(\Delta V'_x)$ less than a preset flicker value from the flicker values $F(\Delta V_x)$ of the grayscale x and get an optimal adjustment voltage of the grayscale x based on adjustment voltages $\Delta V'_x$ corresponding to the flicker values $F(\Delta V'_x)$ of the grayscale x comprises:

obtain a minimum flicker value $F(\Delta V_x^{min})$ from the flicker values $F(\Delta V_x)$ of the the grayscale x and further take an adjustment voltage $\Delta V_x^{min}$ corresponding to the minimum flicker value $F(\Delta V_x^{min})$ as the optimal adjustment voltage of the grayscale x.

10. The liquid crystal display system as claimed in claim 7, wherein obtain flicker values $F(\Delta V'_x)$ less than a preset flicker value from the flicker values $F(\Delta V_x)$ of the grayscale x and get an optimal adjustment voltage of the grayscale x based on adjustment voltages $\Delta V'_x$ corresponding to the flicker values $F(\Delta V'_x)$ of the grayscale x comprises:

calculate an average value of adjustment voltages $\Delta V'_x$ corresponding to the flicker values $F(\Delta V'_x)$ less than the preset flicker value as the optimal adjustment voltage, wherein the preset flicker value is greater than a minimum value of the flicker values $F(\Delta V_x)$ of the liquid crystal display panel and less than a half of a maximum value of the flicker values $F(\Delta V_x)$ of the liquid crystal display panel.

* * * * *